US006100478A

United States Patent [19]

LaPointe et al.

[11] Patent Number: 6,100,478

[45] Date of Patent: Aug. 8, 2000

[54] ELECTROLUMINESCENT KEYPAD

[75] Inventors: Bradley J. LaPointe, Shorewood, Minn.; David G. Sime, Boulder, Colo.

[73] Assignee: Metro-Mark Incorporated, Minnetonka, Minn.

[21] Appl. No.: 09/138,990

[22] Filed: Aug. 24, 1998

Related U.S. Application Data

[62] Division of application No. 08/753,386, Nov. 25, 1996.

[51] Int. Cl.[7] ..... H01H 13/70

[52] U.S. Cl. ..... 200/314; 200/317

[58] Field of Search ..... 200/313, 314, 200/317; 313/506, 509; 315/169.3

[56] References Cited

U.S. PATENT DOCUMENTS

| | | | |
|---|---|---|---|
| 4,060,703 | 11/1977 | Everett, Jr. | 200/5 |
| 4,320,268 | 3/1982 | Brown | 200/5 |
| 4,532,395 | 7/1985 | Zukowski | 200/314 |
| 4,683,360 | 7/1987 | Maser | 200/314 |
| 5,570,114 | 10/1996 | Fowler | 345/173 |
| 5,669,486 | 9/1997 | Shima | 200/314 |
| 5,680,160 | 10/1997 | LaPointe | 345/173 |
| 5,811,930 | 9/1998 | Krafcik et al. | 313/510 |
| 5,818,174 | 10/1998 | Ohara et al. | 315/169.3 |
| 5,844,362 | 12/1998 | Tanabe et al. | 313/506 |
| 5,871,088 | 2/1999 | Tanabe | 200/317 X |

FOREIGN PATENT DOCUMENTS

| | | | |
|---|---|---|---|
| WO96/30919 | 10/1996 | WIPO | H01H 13/02 |

*Primary Examiner*—Renee Luebke
*Attorney, Agent, or Firm*—Thompson & Knight, L.L.P.

[57] ABSTRACT

An electroluminescent keypad, and an electroluminescent lamp, with integral shunts, for use in a keypad. The keypad includes a circuit board that includes a plurality of contact pairs adapted to complete circuits to perform keypad functions. An elastomeric sheet that includes a plurality of key elements overlays the circuit board. Each of the key elements is associated with one of the contact pairs. An electroluminescent lamp with a plurality of integral shunts corresponding to the contact pairs is positioned between the elastomeric sheet and the circuit board.

4 Claims, 2 Drawing Sheets

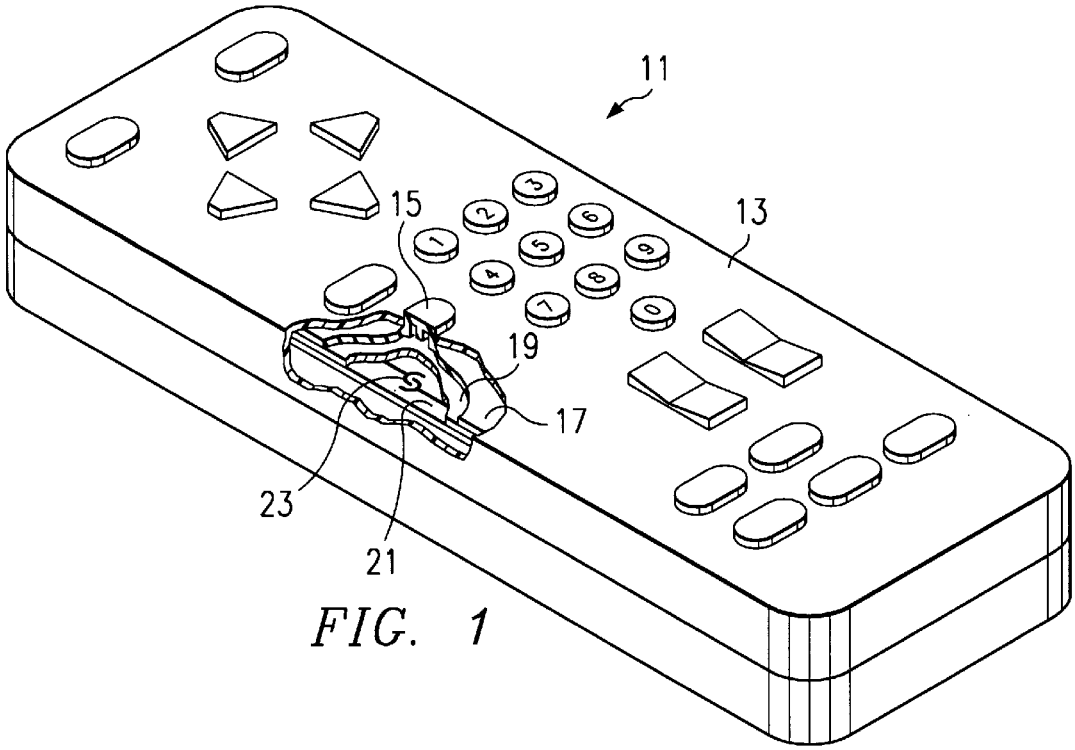
FIG. 1
FIG. 2
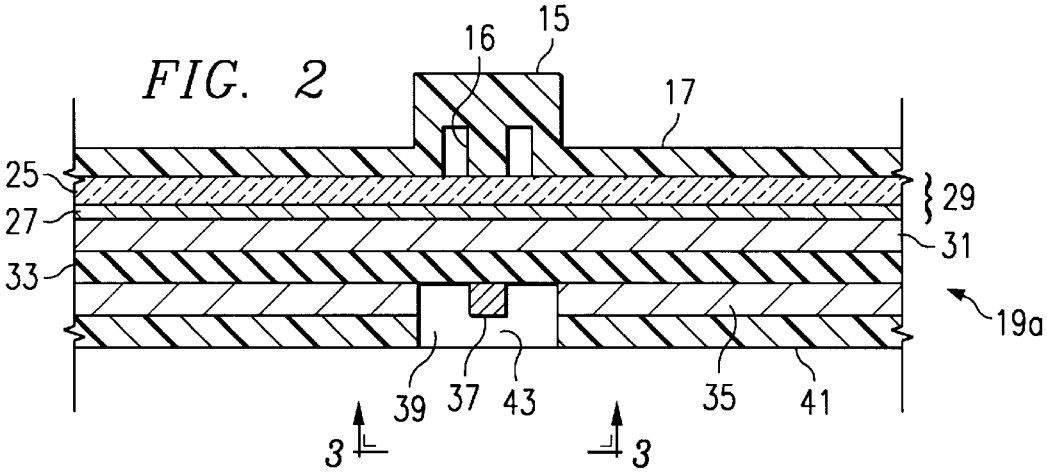
FIG. 3
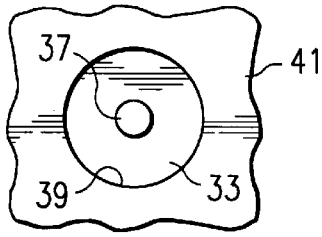

ELECTROLUMINESCENT KEYPAD

CROSS-REFERENCE TO RELATED APPLICATION

This is a Divisional Application of application Ser. No. 08/753,386, filed Nov. 25, 1996, titled Electroluminescent Keypad.

FIELD OF THE INVENTION

The present invention relates generally to keypads and more particularly to an electroluminescent backlit keypad that includes an electroluminescent lamp with integral, preferably printed, shunt elements.

DESCRIPTION OF THE PRIOR ART

Lighted keypads find numerous applications. For example, many consumer electronic devices, such as cellular telephone handsets and television or home entertainment center remote control units, include lighted keypads that enable a user to operate the keypad in a dark or reduced light environment. A particularly efficient way to make an illuminated keypad is with an electroluminescent lamp.

Electroluminescent lamps are well known in the art. They are generally very thin and light weight sheets that can be made in practically any shape. Electroluminescent lamps can be made to produce ideal uniform light levels for keypad illumination, and they are very efficient in terms of power consumption with essentially no heat dissipation. The light distribution can be optimized by selective deposition of material in the lamp.

Currently, illuminated keypads with electroluminescent lamps include a shell that forms the body for the article for which the keypad is a part and contains the keypad elements. The keypads of the prior art include an elastomeric sheet that includes a plurality of key elements. The key elements protrude through holes in the keypad shell and they include an integral operator rod that extends into the body to perform keypad functions. The elastomeric sheet is made of a translucent material and the key elements preferably include opaque coloration applied either to produce dark indicia on a light field or light indicia on a dark field.

An electroluminescent lamp underlies the elastomeric sheet. Currently, the electroluminescent lamp includes a plurality of holes corresponding to the key elements. The operator rods of the key elements pass through the holes. When the electroluminescent lamp is turned on, light shines through the translucent elastomeric sheet but not through the opaque indicia of the key elements.

In one prior art embodiment, the electroluminescent lamp of the illuminated keypad overlays a thin plastic sheet of MYLAR® or the like that has formed on its underside a plurality of conducting shunts positioned to correspond with the key elements of the elastomeric sheet. The conducting shunts are typically made of a graphite ink. The conducting shunts are moved by the operator rods of the key elements into contact with contacts on a printed circuit board that underlies the sheet with the shunts. A thin plastic sheet with holes corresponding to the shunts is positioned between the sheet with the shunts and the printed circuit board. The sheet with the holes keeps the shunts normally spaced apart from the contacts. Additionally, when one of the key elements is depressed, the sheet with the holes ensures that only the appropriate shunt comes into contact with the appropriate contact.

In an alternative prior art embodiment, the bottom surfaces of the operator rods of the key elements, which extend through the holes in the electroluminescent lamp, are coated with a conductor, or have a conducting "pill" adhered thereto, to form a shunt. When a key element is pressed, the conductor makes contact with the contacts on the printed circuit board.

In a further alternative prior art embodiment, the elastomeric keypad actuator rods impinge upon metal or plastic domes attached to or overlying the printed circuit board. The domes are installed to provide tactile feedback, or "snap", to the user. In the case of metal domes, which are usually affixed individually or held in an array by a flexible, adhesive, polyester mat, it is the underside of the domes that provides the electrical shunt that allows the switch to function. Plastic domes are usually formed as embossed locations in a thin sheet of polyester with a conductive coating on the underside that provides the conductive path for the switch function. The operator rods move through holes in the electroluminescent lamp to deform the domes to close the circuits.

There are a number of shortcomings associated with the illuminated keypads of the prior art. The prior art keypad in which the shunts are on a MYLAR® sheet includes three separate sheets of material, i.e., the electroluminescent lamp, the sheet with the shunts, and the perforated spacer sheet. Although they are each relatively thin, the combination of the three sheets does increase the thickness of the unit. Additionally, the three sheet design makes the unit relatively complex to assemble. Also, the electroluminescent lamp must first be fabricated and then punched. Thus, several manufacturing steps are required to make the components and then assemble them into a finished product. The domed sheet embodiment has substantially the same shortcomings. The embodiment in which the conducting shunts are affixed to the ends of the operator rods requires extra steps in the fabrication of the elastomeric key sheet. It is therefore an object of the present invention to overcome the shortcomings of the prior art.

SUMMARY OF THE INVENTION

Briefly stated, the present invention provides an electroluminescent keypad, and an electroluminescent lamp, with integral, preferably printed, shunts for use in a keypad. The keypad of the present invention includes a circuit board that includes a plurality of contact pairs adapted to complete circuits to perform keypad functions. An elastomeric sheet that includes a plurality of key elements overlays the circuit board. Each of the key elements is associated with one of the contact pairs. An electroluminescent lamp with a plurality of integral shunts corresponding to the contact pairs is positioned between the elastomeric sheet and the circuit board.

In one embodiment, the electroluminescent lamp of the present invention includes a flexible transparent substrate with a transparent conducting layer adhered thereto to form a front electrode. An electroluminescent layer is adhered to the transparent conducting layer and a dielectric layer is adhered to the electroluminescent layer. A conducting layer is adhered to the dielectric layer to form a back electrode. An insulating layer is adhered to the conducting layer of the back electrode. At least one conducting shunt is adhered to the insulating layer. The conducting shunt is arranged to engage a contact pair to complete a circuit upon deformation of the electroluminescent lamp. An insulating spacer is adhered to the insulating layer and surrounding said conducting shunt, thereby to keep the shunt normally spaced apart from the contacts of a contact pair.

In another embodiment, the electroluminescent lamp of the present invention again includes a flexible transparent substrate with a transparent conducting layer adhered thereto, an electroluminescent layer adhered to the transparent conducting layer, and a dielectric layer adhered to the electroluminescent layer. In the second embodiment, a conducting layer including at least one void is adhered to the dielectric layer, and a conducting shunt is adhered to the dielectric layer within the void and electrically isolated from the conducting layer. Preferably, the conducting layer and the shunt are applied to the dielectric layer at the same time during manufacture of the electroluminescent lamp. The conducting shunt is again arranged to engage contacts to complete a circuit upon deformation of the electroluminescent lamp. An insulating spacer layer is adhered to the conducting layer. The insulating spacer layer includes a void aligned with the void of the conducting layer.

In yet a further embodiment, the electroluminescent lamp has formed therein domes, by embossing or the like, that underlie the key elements. The conducting shunts are located on or adhered to the undersides of the domes. The domes provide tactile snap when the user operates the keypad.

BRIEF DESCRIPTION OF THE DRAWINGS

FIG. 1 is a partially broken away perspective view of a keypad according to the present invention.

FIG. 2 is a sectional view showing a portion of an elastomeric key sheet and one embodiment of the electroluminescent lamp of the present invention.

FIG. 3 is a view taken along line 3—3 of FIG. 2.

DESCRIPTION OF THE PREFERRED EMBODIMENT

Figure 4:
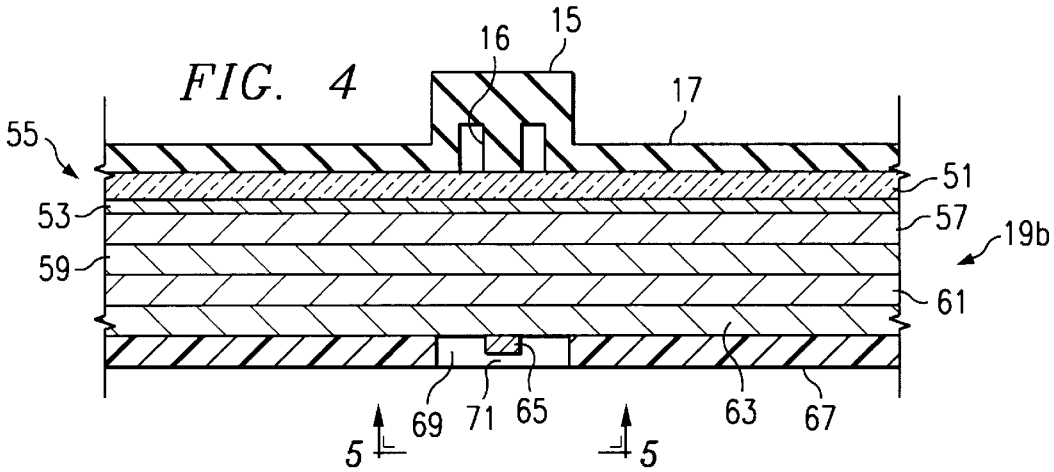
FIG. 4 is a sectional view of a portion of an elastomeric key sheet and an alternative embodiment of the electroluminescent lamp of the present invention.

Referring now to the drawings and first to FIG. 1, a VCR controller is designated generally by the numeral 11. VCR controller 11 includes a shell of plastic or the like that forms a body 13. Controller 11 also includes a plurality of keys, including for example, a key 15. Keys 15 extend through holes in body 13 and form, generally, a keypad. While the keypad of the present invention is illustrated as forming a part of a VCR controller, those skilled in the art will recognize that the keypad of the present invention may be incorporated in other devices, such as telephone handsets and the like.

Keys 15 are formed as key elements of an elastomeric sheet 17. Sheet 17 is formed of a translucent rubbery material. Keys 15 preferably include opaque indicia (not shown) that indicate the keypad function associated with each key.

Elastomeric sheet 17 overlays an electroluminescent lamp 19. The preferred embodiments of electroluminescent lamp 19 will be described in detail hereinafter. However, electroluminescent lamp is preferably of a thin, sheet-like, imperforate construction. When electroluminescent lamp 19 is turned on, it provides illumination inside body 13 of VCR controller 11 to illuminate keys 15.

Electroluminescent lamp 19 overlays a printed circuit board 21. Printed circuit board 21 contains electronic circuit elements and devices that enable VCR controller 11 to operate. Printed circuit board 21 also includes a plurality of contact pairs, including a contact pair 23, that are adapted to be operated by keys 15.

Contact pairs 23 are normally open. As will be shown in detail hereinafter, the bottom side of electroluminescent lamp 19 includes a plurality of preferably printed shunts that correspond to the locations of contact pairs 23. The shunts are normally spaced apart from the contact pairs. When key 15 is depressed, a local region of electroluminescent lamp 19 is moved such that the shunt in that local region moves into conducting engagement with a contact pair 23, thereby to complete a circuit and cause VCR controller 11 to perform one of its functions.

Referring now to FIG. 2, there is a cross-sectional view of elastomeric sheet 17 and one preferred embodiment of the electroluminescent lamp of the present invention, which is designated generally by the numeral 19*a*. Those skilled in the art will recognize that FIG. 2 is not drawn to scale; in actual practice, elastomeric sheet 17 is thicker than the total thickness of electroluminescent lamp 19*a*. FIG. 2 is intended to illustrate clearly the construction of electroluminescent lamp 19*a*. Preferably, electroluminescent lamp 19*a* is on the order of 0.20 to 0.25 mm in thickness, whereas elastomeric sheet 17 is on the order of 1 mm thick.

Electroluminescent lamp 19*a* is preferably built of successive thin layers of material applied using screen printing techniques, although those skilled in the art will recognized that electroluminescent lamps may be fabricated by other techniques, such as coating and lamination. Electroluminescent lamp 19*a* thus includes a transparent flexible substrate 25 upon which successive layers are built. In the preferred embodiment, substrate 25 is a thin sheet of MYLAR® polymer material. Substrate 25 carries a thin transparent layer 27 of a conducting material such as indium tin oxide. Substrate 25 and conducting layer 27 together form a front electrode 29. In the preferred embodiment, the material forming front electrode 29 is purchased as a unit consisting of transparent substrate 25 with conducting layer 27 preapplied thereto. Those skilled in the art will recognize that conducting layer 27 may be applied only to portions of substrate 25, either by selective deposition on substrate 25 or by selective removal of material from a continuous uniformly preapplied layer of conducting material.

Referring still to FIG. 2, a layer of electroluminescent material 31 is adhered to conducting layer 27 of front electrode 29. Electroluminescent layer 31 is composed of an electroluminescent material, such as copper-activated or copper-manganese-activated zinc sulphide (mixed with a polymeric binder). Preferably, electroluminescent layer 31 is applied as a thin layer using screen printing techniques.

Electroluminescent layer 31 has adhered thereto an electrically-insulating dielectric layer 33. In the preferred embodiment, dielectric layer 33 is formed from a material with high dielectric constant such as barium titanate. Dielectric layer 33 is preferably applied to electroluminescent layer 31 by printing.

Dielectric layer 33 is partially covered by a second conducting layer, which forms a back electrode. Dielectric layer 33 also has adhered thereto a conducting shunt 37, which is positioned in an annular void 39 in back electrode 35.

In the preferred embodiment, back electrode 35 and shunt 37 are applied to dielectric layer 33 at the same time using a screen printing technique. More particularly, a printing screen is formed with a plurality of annular areas of emulsion that form masks. The screen is positioned over dielectric layer 33 and an ink of conducting material is applied to the screen. The annular emulsion masks inhibit the deposition of ink at selected portions of dielectric layer 33 and thus form voids 39. As is best shown in FIG. 3, shunt 37 is electrically isolated from back electrode 35.

Finally, an insulating layer 41 is adhered to back electrode 35. Preferably, insulating layer 41 is formed from a thin sheet of material such as MYLAR® with holes corresponding to voids 39. Alternatively, insulating layer 41 may be applied using screen printing techniques by forming a screen with a circular areas of emulsion that form masks corresponding to each void 39 within back electrode 35. The screen is positioned over back electrode 35 and an insulating ink is applied thereto. The emulsion mask areas prevent the insulating ink from being deposited in voids 39. A suitable thickness of insulating layer 41 may be achieved by applying the ink in multiple coats, or by using an ink capable of being printed in a relatively thick coat.

As is well known to those skilled in the art, electroluminescent lamp 19*a* is illuminated by impressing a voltage between front electrode 29 and back electrode 35 by means of suitable electrodes (not shown). The voltage excites the phosphor material in electroluminescent layer 31 causing it to glow.

Recalling FIG. 1, electroluminescent lamp 19*a* overlays printed circuit board 21 with contact Pairs 23. Electroluminescent lamp 19*a* is spaced apart and electrically isolated from printed circuit board 21 by insulating layer 41. As shown in FIG. 2, insulating layer 41 forms a gap 43 between shunt 37 and its associated contact pair 23. Key 15 includes an operator rod 16 that engages electroluminescent lamp 19*a* and is generally aligned with shunt 37. When key 15 is pressed, electroluminescent lamp 19*a* is deformed slightly causing shunt 37 to move through gap 43 into conducting engagement with the contacts of contact pair 23. Insulating layer 41 maintains the remainder of electroluminescent lamp 19*a* electrically isolated from printed circuit board 21 so that only one contact pair 23 is engaged.

Referring now to FIG. 4, there is a cross-sectional view of elastomeric sheet 17 and an alternative preferred embodiment of the electroluminescent lamp of the present invention, which is designated generally by the numeral 19*b*. Again, it will be recognized that FIG. 4 is not drawn to scale; in actual practice, elastomeric sheet 17 is thicker than the total thickness of electroluminescent lamp 19*b*.

Electroluminescent lamp 19*b* is preferably built of successive thin layers of material applied using screen printing techniques. Electroluminescent lamp 19*b* thus includes a transparent flexible substrate 51 upon which successive layers are built up. Substrate 51 carries a thin transparent layer 53 of a conducting material such as indium tin oxide. Substrate 51 and conducting layer 53 together form a front electrode 55.

Referring still to FIG. 4, a layer of electroluminescent material 57 is adhered to conducting layer 53 of front electrode 55, preferably, as a thin layer using screen printing techniques. Electroluminescent layer 57 has adhered thereto an electrically-insulating dielectric layer 59. Again, dielectric layer 59 is preferably applied to electroluminescent layer 57 by printing.

Dielectric layer 59 is coated, preferably by screen printing, with a second conducting layer 61, which forms a back electrode. Second conducting layer 61 is then coated with first insulating layer 63. Then, conducting shunt 65 is applied to first insulating layer 63.

In the preferred embodiment, a plurality of shunts 65 are applied to first insulating layer 63 using a screen printing technique. A printing screen is formed with a plurality of emulsion free areas corresponding to the locations of shunts 65. The screen is positioned over first insulating layer 63 and an ink of conducting material is applied to the screen.

After applying shunts 65, a second insulating layer 67 is adhered to first insulating layer 63, either as a thin sheet of material such as MYLAR® with holes corresponding to form voids 69, or by screen printing techniques using a screen with a circular areas of emulsion that form masks to form voids 69 around shunts 65.

Figure 5:
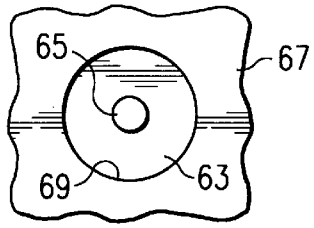
FIG. 5 is a view taken along line 5—5 of FIG. 4.

As is best shown in FIG. 5, second insulating layer 67 is thicker than shunt 65 to form a gap 71. Recalling FIG. 1, electroluminescent lamp 19*b* overlays printed circuit board 21 with contact pairs 23. Electroluminescent lamp 19*b* is spaced apart and electrically isolated from printed circuit board 21 by second insulating layer 67. When a key 15 is pressed, electroluminescent lamp 19*b* is deformed slightly causing shunt 65 to move through gap 71 into conducting engagement with the contacts of contact pair 23. Second insulating layer 67 maintains the remainder of electroluminescent lamp 19*b* electrically isolated from printed circuit board 21 so that only one contact pair 23 is engaged.

It will be noted in the embodiment of FIGS. 4 and 5 that second conducting layer 61, electroluminescent layer 57, and conducting layer 53 of front electrode 55 are coextensive with one another in the region beneath key element 15. Thus, when electroluminescent lamp 19*b* is turned on, the area directly under key element 15 is illuminated. In the embodiment of FIGS. 2 and 3, back electrode 35 includes a void 39 beneath electroluminescent layer 31 and conducting layer 27 of front electrode 29. Thus, when electroluminescent lamp 19*a* is turned on, the area directly under key element 15 is dark, and key element 15 is illuminated by peripheral light. Accordingly, the embodiment of FIGS. 4 and 5 provides more efficient illumination than the embodiment of FIGS. 2 and 3, and the prior art in which there is a hole through the electroluminescent lamp beneath each key element.

Figure 6:
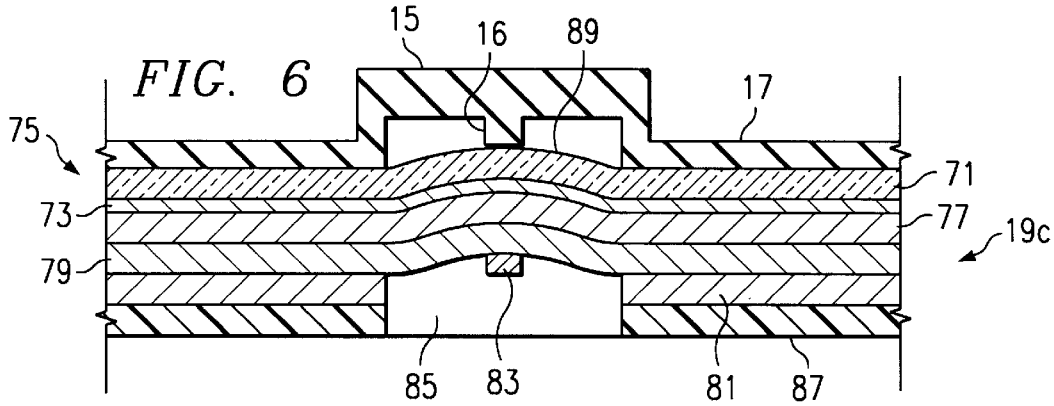
FIG. 6 is a sectional view of a portion of an elastomeric key sheet and a further alternative embodiment of the electroluminescent lamp of the present invention.

Referring now to FIG. 6, there is a cross-sectional view of elastomeric sheet 17 and a further alternative embodiment of the electroluminescent lamp of the present invention, which is designated generally by the numeral 19*c*. Again, it will be recognized that FIG. 6 is not drawn to scale.

Electroluminescent lamp 19*c* is similar in construction to lamp 19*a* of FIGS. 2 and 3, except that it is formed with an integral dome to provide tactile feedback to the user. It is preferably built of successive thin layers of material applied using screen printing techniques. Electroluminescent lamp 19*c* thus includes a transparent flexible substrate 71 upon which successive layers are built up. Substrate 71 carries a thin transparent layer 73 of a conducting material such as indium tin oxide. Substrate 71 and conducting layer 73 together form a front electrode 75.

Referring still to FIG. 6, a layer of electroluminescent material 77 is adhered to conducting layer 73 of front electrode 75, preferably, as a thin layer using screen printing techniques. Electroluminescent layer 77 has adhered thereto an electrically-insulating dielectric layer 79. Again, dielectric layer 79 is preferably applied to electroluminescent layer 77 by printing.

Dielectric layer 79 is partially covered by a second conducting layer 81, which forms a back electrode. Dielectric layer 79 also has adhered thereto a conducting shunt 83, which is positioned in an annular void 85 in back electrode 81. In the preferred embodiment, back electrode 81 and shunt 83 are applied to dielectric layer 79 at the same time using a screen printing technique.

Finally, an insulating layer 87 is adhered to back electrode 81, either by adhering a sheet of MYLAR® or the like having holes corresponding to void 85 within back electrode 81, or by printing a layer of insulating ink on back electrode 81. After insulating layer 87 has been adhered to back electrode 81, the completed electroluminescent lamp is embossed to form a plurality of domes 89 to underlie key elements 15 and operator rods 16 of sheet 17. Domes 89 are preferably formed by applying heated dies to the lamp thereby to deform plastic sheet 71 and the layers applied thereto.

Figure 7:
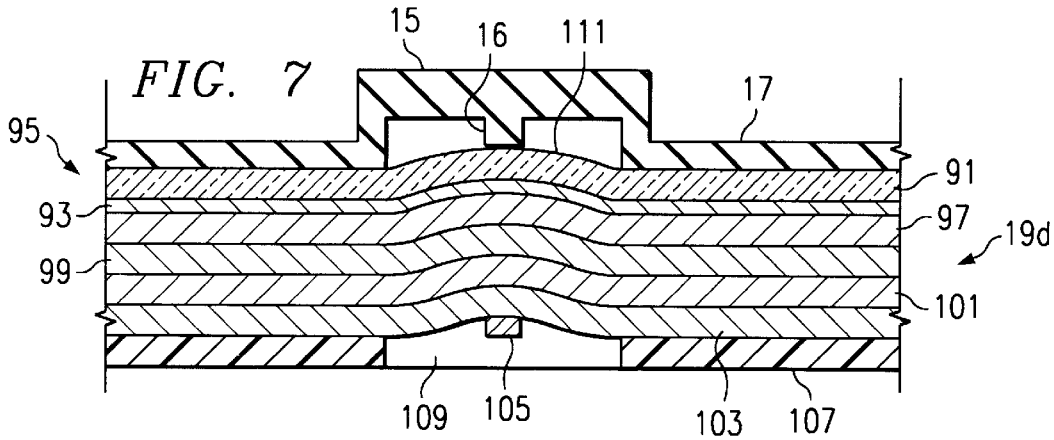
FIG. 7 is a sectional view of a portion of an elastomeric key sheet and yet a further alternative embodiment of the electroluminescent lamp of the present invention.

Referring now to FIG. 7, there is a cross-sectional view of elastomeric sheet 17 and yet a further alternative embodiment of the electroluminescent lamp of the present invention, which is designated generally by the numeral 19*d*.

Electroluminescent lamp 19*d* is similar in construction to lamp 19*b* of FIGS. 4 and 5, except that it is formed with an integral dome to provide tactile feedback to the user. Electroluminescent lamp 19*d* includes a transparent flexible substrate 91. Substrate 91 carries a thin transparent layer 93 of a conducting material. Substrate 91 and conducting layer 93 together form a front electrode 95.

A layer of electroluminescent material 97 is adhered to conducting layer 83 of front electrode 95. Electroluminescent layer 97 has adhered thereto an electrically-insulating dielectric layer 99. Dielectric layer 99 is coated with a second conducting layer 101, which forms a back electrode. Second conducting layer 101 is then coated with first insulating layer 103. Then, a conducting shunt 105 is applied to first insulating layer 103.

In the preferred embodiment, a plurality of shunts 105 are applied to first insulating layer 103 using a screen printing technique. After applying shunts 105, a second insulating layer 107 is applied to first insulating layer 103, either by adhering a sheet of MYLAR® or the like having holes that form voids 109 around shunts 105, or by printing a layer of insulating ink on first insulating layer 103. After second insulating layer 107 has been adhered to first insulating layer 103, the completed electroluminescent lamp is embossed to form a plurality of domes 111 to underlie key elements 15 and operator rods 16 of sheet 17. Domes 111 are preferably formed by applying heated dies to the lamp thereby to deform plastic sheet 91 and the layers applied thereto.

It will be recognized that certain of the layers of electroluminescent lamp 19 may be applied only in selected regions so as to reduce the amount of material used in making the lamp and to reduce the power consumed in operating the lamp. For example, the electroluminescent, dielectric, and second conducting layers may be applied only in areas corresponding to the key elements, with suitable provision being made for conductivity. By selectively applying the material, only the keys are illuminated, rather than the entire interior of the controller.

From the foregoing, those skilled in the art will recognize that the present invention is well adapted to overcome the shortcomings of the prior art. The present invention provides a single sheet, rather the three sheets of the prior art keypads. The single sheet design reduces substantially the complexity of assembling the unit. Also, since the electroluminescent lamp of the present invention is substantially imperforate, it does not need to be punched. Thus, several manufacturing steps are eliminated in manufacturing the components and then assembling them into a finished product.

What is claimed is:

1. An electroluminescent lamp comprising:

a flexible transparent substrate;

a transparent conducting layer adhered to said transparent substrate;

an electroluminescent layer adhered to said transparent conducting layer;

a dielectric layer adhered to said electroluminescent layer;

a second conducting layer adhered to said dielectric layer, said second conducting layer including at least one void;

a conducting shunt adhered to said dielectric layer and aligned with said void and electrically isolated from said second conducting layer, said conducting shunt being arranged to engage contacts of a circuit upon deformation of said dielectric layer; and, an insulating spacer layer adhered to said second conducting layer, said insulating spacer layer including a void aligned with the void of said second conducting layer.

2. The electroluminescent lamp of claim 1, wherein said substrate, transparent conducting layer, electroluminescent layer, and dielectric layer form an integral dome structure having a convex upper surface formed of said substrate and a concave lower surface formed of said dielectric layer.

3. A keypad comprising:

a circuit board, said circuit board including a plurality of contact pairs;

an elastomeric sheet overlaying said circuit board, said elastomeric sheet including a plurality of key elements, each of said key elements being associated with one of said contact pairs; and, an electroluminescent lamp disposed between said elastomeric sheet and said circuit board, said electroluminescent lamp including:

a flexible transparent substrate underlying said elastomeric sheet;

a transparent conducting layer adhered to said transparent substrate;

an electroluminescent layer adhered to said transparent conducting layer;

a dielectric layer adhered to said electroluminescent layer;

a second conducting layer adhered to said dielectric layer, said second conducting layer including a plurality of voids, each of said voids being arranged to correspond to one of said key elements and its associated contact pair;

a plurality of conducting shunts adhered to said dielectric layer, each of said conducting shunts adhered to said dielectric layer and aligned with one of said voids and electrically isolated from said second conducting layer, each said conducting shunts being arranged to engage one of said contact pairs upon actuation of one said key elements; and, an insulating spacer layer adhered to said second conducting layer, said insulating spacer layer including a plurality of voids aligned with the voids of said second conducting layer.

4. The keypad of claim 3, wherein said substrate, transparent conducting layer, electroluminescent layer, and dielectric layer form a plurality of integral dome structures, having a convex upper surface formed of said substrate and a concave lower surface formed of said dielectric layer.

* * * * *